United States Patent [19]

Kotsch et al.

[11] Patent Number: 4,953,832

[45] Date of Patent: Sep. 4, 1990

[54] APPARATUS FOR THE CONTROLLED COOLING OF HOT ROLLED STEEL SAMPLES

[75] Inventors: Gary D. Kotsch, Annville; Philip M. Giles, Jr., Bethlehem; Raymond H. Biemiller, Harrisburg, all of Pa.

[73] Assignee: Bethlehem Steel Corporation, Bethlehem, Pa.

[21] Appl. No.: 173,709

[22] Filed: Mar. 24, 1988

[51] Int. Cl.[5] ..... C21D 1/667

[52] U.S. Cl. ..... 266/82; 266/80; 266/113; 266/114; 266/259

[58] Field of Search ..... 266/80, 82, 113, 114, 266/259

[56] References Cited

U.S. PATENT DOCUMENTS 4,110,092 8/1978 Kunioka et al. ..... 266/259

FOREIGN PATENT DOCUMENTS 5974242 4/1984 Japan ..... 266/80

*Primary Examiner*—Deborah Yee

*Attorney, Agent, or Firm*—John I. Iverson

[57] ABSTRACT

A method and apparatus for cooling samples of hot rolled steel sections. A programmable controller directs a predetermined sequence of air and cooling water sprays against the sample while held in a closed container. The controlled cooling of the sample prevents dimensional distortion of the sample so that accurate measurements of the finished hot rolled steel section can be determined.

3 Claims, 1 Drawing Sheet

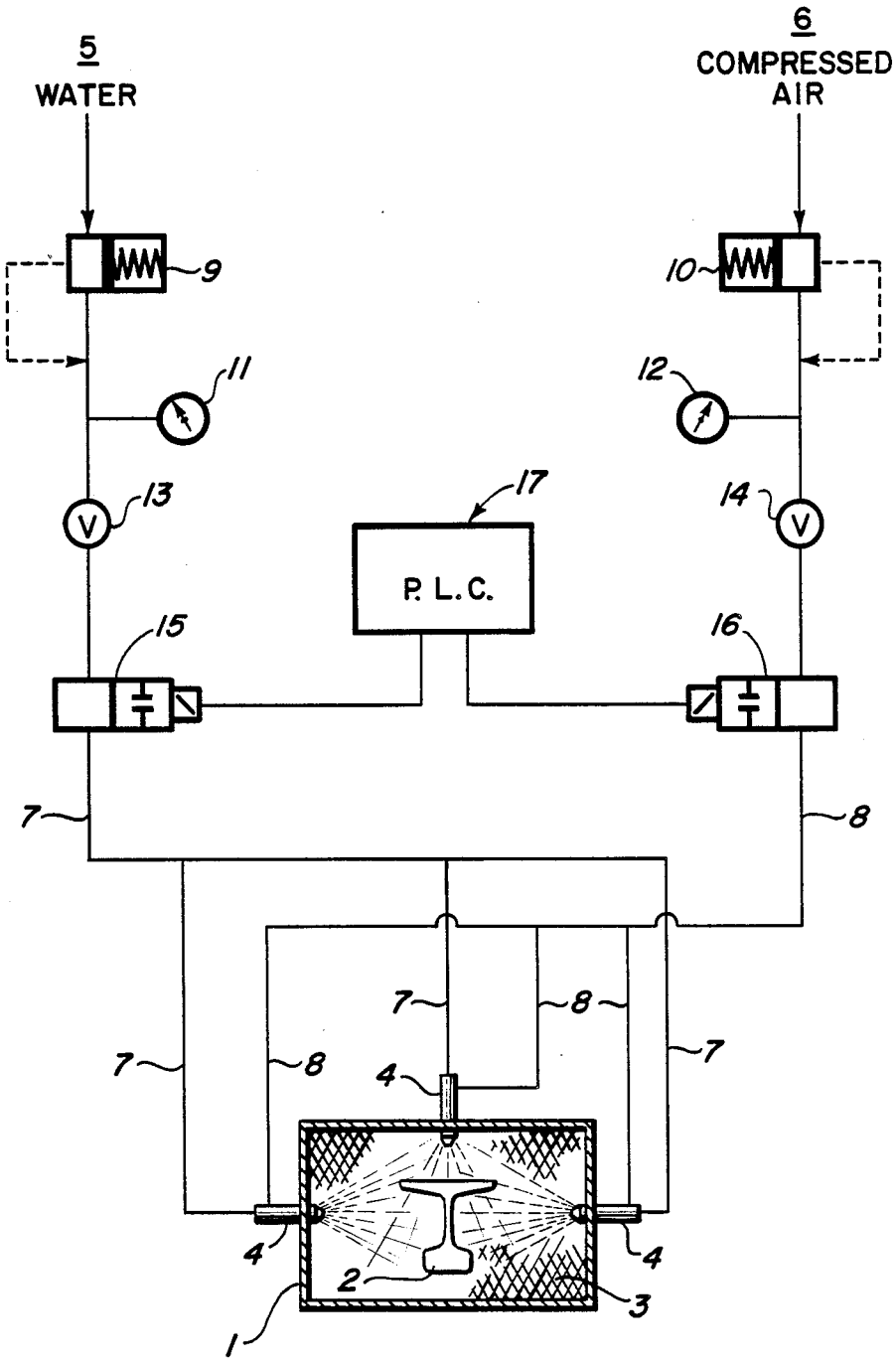
5
WATER
6
COMPRESSED
AIR
9
10
11
12
13
14
17
P. L. C.
15
16
7
8
7
8
7
8
7
4
4
4
2
3
1

APPARATUS FOR THE CONTROLLED COOLING OF HOT ROLLED STEEL SAMPLES

BACKGROUND OF THE INVENTION

This invention relates to the hot rolling of metals, especially steel. It relates particularly to the hot rolling of rail and other elongated steel sections and shapes.

In the hot rolling of steel rails, a red-hot bloom is passed through a sequence of rolls which gradually reshape the hot steel into a standard railroad rail section having a head, web and base. The rails which are rolled at temperatures well over 1800° F. are then cooled under controlled conditions to prevent distortion of the rail and the formation of internal defects. Finished steel rail is subjected to very stringent specifications and inspections. The finished rail must conform to dimensional specifications that permit variations of only 1/32 of an inch or less.

During the hot rolling of the rail, the operator regularly checks samples of the finished rail to determine whether it meets the required dimensional specifications since the shaping rolls are constantly being worn or can get out of adjustment during the rolling. For the past 120 years, the roller for sampling, has cut a short section from the end of a hot finished rail and rapidly cooled the sample by plunging it into a water tank thereby cooling it down to ambient temperature within a few minutes. The roller then checked the dimensions of the cooled sample with a gage to determine whether it met specifications. If not, the roller made adjustments in the settings of the shaping rolls to correct for the dimensional variations based on the measurements of the cooled sample.

It has been discovered that many of the samples taken during the hot rolling of steel rail do not provide accurate information concerning the dimensions of the finished rail due to the fact that the austenite in the hot sample was rapidly changed to martensite during the rapid quench in water whereas the elongated finished rail was allowed to cool more slowly to form a desirable pearlitic structure. Steels that contain alloy additions to increase the hardness of the steel often change dimensions if not cooled properly. As a result, significant dimensional differences often existed between the rapidly cooled sample and the slowly cooled finished rail section.

SUMMARY OF THE INVENTION

It is an object of this invention to provide a method and apparatus for the controlled cooling of hot rolled steel samples.

It is a further object of this invention to provide a method and apparatus for the cooling of hot rolled steel samples that can be programmed to cool a variety of hot rolled steel samples of various grades and sizes.

It is a still further object of this invention to provide a method and apparatus for the cooling of hot rolled steel samples that avoids variations resulting from manual quenching of the sample.

It has been discovered that the foregoing objectives can be attained by apparatus designed for the controlled cooling of hot rolled steel samples comprising a closable sample container, a plurality of spray nozzles within the container, conduits connecting the nozzles to a source of cooling water and to a source of compressed air and a programmable controller programmed to spray predetermined amounts of cooling water and compressed air from the nozzles against the sample for a predetermined period of time.

BRIEF DESCRIPTION OF THE DRAWINGS

FIG. 1 is a functional block diagram with a top sectional view of the sample container to illustrate the features of the apparatus of this invention.

DESCRIPTION OF THE PREFERRED EMBODIMENT OF THE INVENTION

As shown in FIG. 1, a preferred embodiment of the apparatus of this invention uses a covered box-like container 1 made of heavy gage steel to contain a hot sample 2 of rolled steel rail. The sample is cut by a saw at the finishing end of the rolling mill and the container 1 is preferably positioned close to the position of the saw so that the operator can easily place the sample 2 in it. The box-like container 1 is preferably provided with a lid and a screen base 3 or drain to allow the cooling water to drain away from the sample.

A plurality of spray nozzles 4 are positioned in the container 1 and are directed towards the sample 2. Each of the nozzles 4 is connected to a source 5 of cooling water under pressure and a source 6 compressed air by conduits 7 and 8. Pressure regulators 9 and 10, pressure gages 11 and 12 and manual valves 13 and 14 are provided in conduits 7 and 8 to adjust the pressure and flow rates of the cooling water and compressed air to predetermined levels.

Solenoid operated valves 15 and 16 are also positioned in conduits 7 and 8 and are electrically connected to a programmable logic controller 17.

To cool a sample using the apparatus and method of this invention, the saw operator cuts off a sample of the hot rail while it is at a temperature above 1800° F. and places it in container 1 and closes the lid of the container 1. He then activates the programmable logic controller 17 by pushing the start button. The controller 17 has been programmed with the amount and time of cooling required for the size and grade of hot steel sample to be cooled. The controller 17 causes solenoid valves 15 to open and close in accordance with the predetermined program to produce a series of water and air mist like sprays to be directed against sample 2 from nozzles 4 until the temperature of the sample falls below 100° F. The sample 2 is then removed from container 1 and its dimensions are measured by the operator.

As an example, when cooling a sample of 132 RE medium hardness rail, the controller 17 is programmed to direct an 8 second air/water mist, followed by a 22 second off period. This cycle is repeated 6 times for a total of 3 minutes. Then 180 seconds of air water mist is sprayed on the sample, thus completing the cycle. In the above example, the air pressure is set between 28–32 PSI and the water pressure about 4–5 PSI. The nozzles were sized to permit an air flow of about 20 SCFM and a water flow of less than 1 GPM. An Allen-Bradley Model SLC-100 Controller was used to program and control the cooling cycle.

If desired, the controller can be provided with gages or displays to indicate the cooling sequence and an alarm to alert the operator when the sample has been cooled to ambient temperature. The operator then removes the cooled sample 2 from the container 1 and using a gage or micrometer, checks the dimensions of the sample.

It can be seen that the apparatus and method of this invention provides a simple but effective means for producing accurate samples of the hot rolled sections.

While the present invention has been described and illustrated with our preferred embodiment, it will be appreciated by those skilled in this art, after understanding this invention, that various changes and modifications may be made without departing from the spirit and scope of this invention. It is therefore intended that all such changes and modifications will be included in the following claims.

We claim:

1. Apparatus for the controlled cooling of a hot steel sample or samples in preparation for laboratory analysis comprising a closable sample container, a plurality of spray nozzles within said container, conduits connecting said nozzles to a source of cooling water and to a source of compressed air, programmed means to spray predetermined amounts of cooling water and compressed air from said nozzles against said sample for predetermined periods of time.

2. The apparatus of claim 1 in which the closable sample container is provided with a drain.

3. The apparatus of claim 1 in which the spray nozzles are adapted to spray cooling water or compressed air or both cooling water and compressed air.

* * * * *